US005146938A

United States Patent [19]

Lutener et al.

[11] Patent Number: 5,146,938

[45] Date of Patent: * Sep. 15, 1992

[54] CLEANING OF MILL GEARS

[76] Inventors: Stuart B. Lutener, 7557-10th Ave., P.O. Box 3029, Fort Saskatchewan, Alberta, Canada, T6K 2T8; David W. Burns, 1802-32 Avenue, Vernon, B.C., Canada, V1T 2J4

[ * ] Notice: The portion of the term of this patent subsequent to Jul. 16, 2008 has been disclaimed.

[21] Appl. No.: 726,838

[22] Filed: Jul. 8, 1991

Related U.S. Application Data

[63] Continuation of Ser. No. 558,472, Jul. 27, 1990, Pat. No. 5,031,648, which is a continuation-in-part of Ser. No. 352,316, May 16, 1989, abandoned.

[51] Int. Cl.[5] ..... B08B 3/04; C23G 5/024

[52] U.S. Cl. ..... 134/32; 134/40; 134/42; 252/170; 252/162; 252/DIG. 8

[58] Field of Search ..... 134/32, 40, 42, 22.17; 252/170, 162, DIG. 8

[56] References Cited

U.S. PATENT DOCUMENTS 3,167,514 1/1965 Baker ..... 252/170
5,031,648 7/1991 Lutener et al. ..... 134/42

*Primary Examiner*—Theodore Morris

*Assistant Examiner*—Zeinab El-Arini

[57] ABSTRACT

The present invention relates to a composition and a method of cleaning lubricated surfaces subject to residual buildup such as large mill gears, shovels and draglines. The composition comprises at least one terpene being capable of dissolving or softening hardened lubricants and residuals, hydrocarbon solvent, an extreme pressure lubricant and surfactants. The method for cleaning mill gears comprises applying a solution comprising at least one terpene being capable of dissolving or softening soils containing grease or oil, aliphatic hydrocarbon solvent, biodegradable surfactants, an extreme pressure lubricant and thickeners to the area to be cleaned, continuously applying the solution to contact the surface and penetrate and dissolve the surface grease, and thereafter rinsing the surface to remove the dissolved surface greases and the cleaning composition. The initial spraying is carried out during use of the mill gear whereas the rinsing is carried out as the mill gear is inched. The present invention provides a composition which dissolves gear lube accumulations effectively and in an environmentally acceptable manner as well as a method of cleaning mill gears resulting in significant savings in terms of labor and downtime of the equipment. The solution is safe to use on painted surfaces and emulsifies quickly when sprayed with water-soap solutions.

16 Claims, No Drawings

CLEANING OF MILL GEARS

This is a continuation application of application Ser. No. 07/558,472, filed on Jul. 27, 1990, now U.S. Pat. No. 5,031,648, which is a continuation-in-part application of application Ser. No. 07/352,316, filed on May 16, 1989, now abandoned.

FIELD OF THE INVENTION

The present invention relates to a cleaning composition and method for cleaning of surfaces contaminated with lubricants and residuals, and in particular, a cleaning composition and method for cleaning of large mill gears.

BACKGROUND OF THE INVENTION

During operation, heavy equipment such as that used in the mining industry, for example large mill gears, shovels and draglines, becomes coated with soil such as surette and lube grease and residues from the processing operations employing such equipment. In order to prolong the life of such equipment it is necessary to provide regular cleaning so that preventive maintenance may be carried out.

In the past, when equipment such as large mill gears were to be cleaned for regular maintenance or inspection procedures it was generally necessary to shut down the operation and manually clean the equipment with scrapers and rags. This procedure could take a crew of as many as five men up to a week to properly clean the mill gears. In order to reduce the downtime associated with such a method, an alternative chemical method for removing surette and lube grease prior to inspection, welding or non-destructive testing of shovel and drag line components and large mill gears was developed. This chemical method allowed cleaning during at least partial use of the mill gears and for this reason had a major advantage over earlier cleaning techniques. In order to provide adequate solvency for cleaning, this chemical method utilized methylenechloride based products which have a major disadvantage in that they are toxic and require persons using such compositions to wear self-contained breathing apparatus. Additionally, if the methylenechloride solutions contacted any painted surfaces, such contact could result in the rapid removal of the paint from the surface. Therefore, although this method allowed cleaning during use of the mill gears, the personnel preparation time and level of care required result in a cleaning technique which is not satisfactory. It must be recognized that the cleaning of large mill gears must protect the gears against the extreme pressure normally encountered therein. Furthermore, a less toxic and less hazardous cleaner is required which will still allow effective cleaning with little downtime.

SUMMARY OF THE INVENTION

The present invention relates to a cleaning composition and a method of cleaning, in particular, mill gears and the like. The composition comprises at least one terpene capable of dissolving and softening soils associated with the lubrication of mill gears, aliphatic hydrocarbon solvent, an extreme pressure lubricant, and surfactants. This composition is generally non-toxic and environmentally preferred over existing chemical cleaning compositions for mill gears. The preferred terpene is d-limonene.

The method of cleaning mill gears allows cleaning during use of the mill gears, thus significantly reducing downtime and the actual cost of the cleaning of the mill gears. The cleaning composition replaces the normal lubrication fluid and is sprayed on the mill gears as they continue to operate. The extreme pressure lubricant is provided in sufficient quantity to protect the gears against damage or fire. After a sufficient time period of exposing the mill gears to the cleaning composition (normally one and a half to two hours), the operation is stopped and the mill gears are inched and subjected to a high pressure rinse with a emulsifier soap to remove the cleaning composition. Once rinsed, the gears may then be inspected for damage.

DETAILED DESCRIPTION OF THE INVENTION

The composition of present invention for cleaning of soil lubrication accumulations from equipment such as large mill gears, shovels and draglines comprises at least one terpene being capable of dissolving or softening soils containing grease or oil, hydrocarbon solvents, an extreme pressure lubricant, and surfactants (preferably biodegradable). The viscosity of the solution may be adjusted by the addition of thickeners and thereby control the characteristics of the cleaning composition to maintain contact and ensure lubrication of the mill gears.

The preferred terpenes, capable of dissolving or softening soils containing grease or oil, are provided in crude form as an isolate or an essential oil from plants such as pine or citrus. Preferred terpenes include turpentine, pine oil or lemon oil which contain significant quantities of terpenes to dissolve or soften soil containing grease or oil. The terpenes are preferably provided in relatively purified form as isolated terpenes, preferably isolated monoterpenes, such as for example, pinene or limonene and most preferably, d-limonene. The terpenes act as very potent solvents with grease cutting activities are less toxic and safer to handle than the prior art chemical cleaners.

In most cases, the amount of terpenes, in particular d-limonene, is determined by financial considerations. These materials are potent solvents for grease and have been found to work effectively alone or in combination with hydrocarbon cleaning solvents. In certain applications, the rate of cleaning can be paramount such that the percentage of terpene would be increased. In other cases time is less critical and the percentage of terpene can be decreased by substituting hydrocarbon cleaning solvents. Thus the percentage of terpene in the composition can be varied as a function of product cost and product performance rate. The amount of extreme pressure lubricant can vary with the particular application and the particular manufacturer of the lubricant. It is critical in the cleaning of mill gears which continue to operate for part of the cleaning process to protect the gears by proper lubrication to avoid gear damage by overheating and possible fire.

The hydrocarbon solvents include aromatic and aliphatic solvents. The aromatic solvents are preferably benzene or toluene. The aliphatic solvents are preferably aliphatic petroleum solvents such as naphtha, kerosene or mineral spirits, most preferably, mineral spirits such as for example, those sold under the trade mark VARSOL (Esso).

The surfactants utilized in the composition are preferably biodegradable non-ionic surfactants. Among the non-ionic surfactants suitable for the composition of the present invention are condensates of alkanolamine with fatty acids and condensates of ethylene oxide with fatty acids, fatty alcohols or alkyl aryls. Among the condensates of alkanolamine and fatty acids, condensates of ethanolamine and $C_{12}$ to $C_{18}$ fatty acids are preferred, most preferably, condensates of diethanolamine with coconut oil fatty acids, namely cocofattyacid diethanolamide. Among the condensates of ethylene oxide with fatty acids, fatty alcohols or alkyl aryls, preferred are condensates of ethylene oxide with alkyl aryls and in particular, ethylene oxide condensates of alkyl phenol wherein the alkyl group attached to the phenol has from 6 to 15 carbon atoms, most preferably, 9 carbon atoms, i.e. nonylphenolethoxylate. The number of ethylene oxides condensed with the nonylphenol can range from 6 to 15 moles of ethylene oxide per mole of nonylphenol, most preferably, about 9 moles.

The thickeners of the composition of present invention are utilized to provide the proper viscosity to allow the composition to remain in contact with the mill gears to ensure lubrication thereof and to allow lubrication accumulations to be softened and eventually removed. Such a solution is a free-flowing solution having a viscosity similar to corn syrup or heavy pancake syrup. The thickeners for use with the cleaning composition include polymers such as for example carboxyvinyl polymers sold under the trade mark CARBOMER and fatty acid amines such as for example, cocoamine.

A coupling agent or co-solvent such as a lower aliphatic alcohol and preferably a lower alkyl alcohol such as isopropyl alcohol can be provided to enhance the homogeneity of the solution.

In the cleaning of mill gears an extreme pressure lubricant is provided, such as for example, those lubricants sold under the trade mark HITEC by Ethoyl Petroleum Additives, Toronto, Ontario, preferably, the extreme pressure additive HITEC 320. With this particular extreme pressure lubricant 0.5% to 3.0% is preferred. The lower level of the extreme pressure lubricant is suitable for mill gears used in two pinion gear arrangements used in pulp and paper kilns. This extreme pressure lubricant in an amount of 1.8% has been used in large diameter mill gears used in mining and provides adequate protection for cleaning on the fly. It is apparent the lower limit of the extreme pressure lubricant is the most critical whereas the upper limit is really based on cost and diminishing return. An upper limit of about 15% is practical for most applications.

Cleaning on the fly implies commencing the cleaning operation as the equipment continues to run. The cleaning solution replaces the normal lubricant and the equipment continues to operate as the solution is loosening and removing debris from the gears while still protecting the gears from damage. This period is normally used to complete a particular run of the mill which is less demanding than the normal application. It has been found that cleaning on the fly works quite satisfactorily and substantially reduces downtime and thus substantially reduces the cost of cleaning and inspection.

Other extreme pressure lubricants can be used and are normally phosphorous sulphur compounds. The amount of the compound used will vary with the product and the particular application. It is highly preferred that non-toxic extreme pressure lubricants be used. These extreme pressure lubricants are relatively expensive and this provides an incentive to the limit the amount actually used. Generally, if there is not sufficient quantity of the extreme pressure lubricant, frictional heat generation, during use of the product will be too great resulting in an unacceptable temperature rise. The solution is to add more extreme pressure lubricant. The manufacturer of the extreme pressure lubricant will be able to make recommendations with respect to the required amount for a particular application.

A preferred cleaning composition comprises d-limonene, mineral spirits, carboxyvinylpolymer, cocoamine, cocofattyacid diethanolamide, nonylphenolethoxylate, isopropyl alcohol and water. The preferred range of these components is listed in the following table:

| Component | Preferred Range |
|---|---|
| 1. D-Limonene | 15–40% |
| 2. Mineral Spirits | 30–60 |
| 3. Carboxyvinylpolymer | 0.1–1 |
| 4. Cocoamine | 1–4 |
| 5. Cocofattyacid diethanolamide | 2.5–5 |
| 6. Nonylphenolethoxylate | 2.5–5 |
| 7. Isopropyl alcohol | 2.5–5 |
| 8. Water | 1.5–4 |

For applications requiring an extreme pressure lubricant, such as mill gears, it is added in the preferred range of 0.5% to 3.0%.

Components 3 through 8 are used to enhance the cleaning capability of components 1 and 2 are used to vary the properties of the cleaning composition for a particular application.

The amount of the cleaning composition required for cleaning of equipment depends upon the size of the area to be cleaned. For most shovels and draglines, generally 400 to 1000 liters of the cleaning composition is required. For mill gears the amount of the cleaning composition depends upon the size of the mill gear. For 12 to 18 foot diameter gears, generally 100 to 150 liters of the cleaning composition is required, while 32 to 36 foot diameter gears generally require 300 to 500 liters.

The following examples illustrate the preparation of a composition of the present invention and its use in methods for cleaning of shovels, draglines and large mill gears.

Preparation 1

Cleaning Composition for Shovels and Drag-Lines

A composition was prepared as follows having the following components (all % are w/w)

| | |
|---|---|
| D-Limonene | 24.5% |
| Mineral Spirits | 56.8% |
| Carboxyvinylpolymer | 0.7% |
| Cocoamine | 2.8% |
| Cocofattyacid diethanolamide | 3.8% |
| Nonylphenolethoxylate | 3.8% |
| Isopropyl alcohol | 3.8% |
| Water | 3.8% |

The composition was prepared by first mixing together 415 kg d-limonene, 963 kg of VARSOL, 11.6 kg of CARBOMER 941, 48.1 kg of cocoamine, 64.7 kg of cocofattyacid diethanolamide and 64.7 kg of nonylphenolethoxylate to form a homogeneous solution. Thereafter 64.7 kg of isopropyl alcohol and 64.7 kg of water were added and the solution mixed. The resulting composition was a viscous pale yellow to colorless liquid with a pleasant lemon odor and a specific gravity of 0.83. The liquid had a flash point of 110°-120° F. by the Tag Closed Cup method.

Preparation 2

Cleaning Composition for Mill Gears

A composition was prepared as follows having the following components (all % are w/w)

| | |
|---|---|
| D-Limonene | 24.5% |
| Mineral Spirits | 56.8% |
| Carboxyvinylpolymer | 0.7% |
| Cocoamine | 2.8% |
| Cocofattyacid diethanolamide | 3.8% |
| Nonylphenolethoxylate | 3.8% |
| Isopropyl alcohol | 3.8% |
| EP Additive | 1.8% |
| Water | 2.0% |

The composition was prepared by first mixing together 415 kg d-limonene, 963 kg of VARSOL, 11.6 kg of CARBOMER 941, 48.1 kg of cocoamine, 64.7 kg of cocofattyacid diethanolamide and 64.7 kg of nonylphenolethoxylate to form a homogeneous solution. Thereafter 64.7 kg of isopropyl alcohol, 31.5 kg of EP Additive and 33.2 kg of water were added and the solution mixed. The resulting composition was a viscous pale yellow to colorless liquid with a pleasant lemon odor and a specific gravity of 0.83. The liquid had a flash point of 110°-120° F. by the Tag Closed Cup method.

Cleaning of Shovel and Drag Lines

A hot water pressure unit of approximately 5 gallons per minute at 1500 to 2000 PSI was used to flush loose dirt and grease from areas of the shovel or dragline to be cleaned, especially on the car body areas. Thereafter, the areas to be cleaned were sprayed with 400 to 1000 liters of a composition prepared according to Preparation 1 utilizing a 10:1 air pump complete with hose and wand. The shovel or drag-line was sprayed in a predetermined pattern to allow pressure washing to follow in each sprayed area as the composition penetrated and dissolved the surface greases. As the composition is safe on painted areas the outside and inside of the car body was also effectively cleaned. After the surface greases had dissolved, the pressure washer was used with a water-emulsifier soap solution to flush the dissolved greases free from the surface.

Cleaning of Mill Gear and Pinion Prior to Maintenance

A 32 foot diameter mill gear was sprayed with approximately 400 liters of the composition prepared according to Preparation 2 using a 10:1 air pump while the gear was in operation. This spraying operation directs the spray at the mill gear and is subsequently collected. This spraying operation continues for approximately 1.5 to 2 hours. The position of the spraying generally coincides with the position of the spray lubes associated with the mill gear. This spray is not allowed in the flotation circuits. The spraying operation is controlled to spray both the outer edges of the gear face and the gear faces. Any run out of the mill is then completed. A 20 to 30 minute flushing operation follows with the mill gear being inched. Preferably the flush is a hot water high pressure(1200 to 2000 psi) flush using TRAXOL DETRAX used to flush the gear and pinion surfaces. TRAXOL DETRAX is a water-emulsifier soap solution. After the cleaning has been completed, the mill is shut down, the guards for the mill gear removed and the gear and pinions inspected and non-destructively tested.

The entire cleaning operation takes approximately 2.0 to 2.5 hours with cleaning during operation of the mill gears taking 1.5 to 2.0 hours followed by a rinsing operation of 20 to 30 minutes where the mill gears are inched. Thus, the ratio of the time the mill gear is in operation to the time it is only inched is greater than 5 to 1 and, in some cases, is greater than 4 to 1.

The preferred cleaning composition provides an effective method of cleaning lubricated surfaces including mill gears. The efficient cleaning makes routine inspection and maintenance programs more feasible to carry out. The cleaning composition is easily removed as it emulsifies quickly when contacted with water soap solutions. The preferred method also provides cleaning of mill gears generally as they operate reducing downtime and reducing risk to personnel as they are not exposed to highly toxic chemicals of the prior art chemical method.

Although various preferred embodiments of the present invention have been described herein in detail, it will be appreciated by those skilled in the art that variations may be made thereto without departing from the spirit of the invention or the scope of the appended claims.

We claim:

1. A method of cleaning mill gears and large diameter industrial drive gears soiled with gear lubes, greases and hardened residues which are difficult to remove, said method comprising applying a cleaning solution which does not include methylene-chloride, said cleaning solution being capable of dissolving or softening hardened lubricating residues on said gears during operation of the gears, said cleaning solution comprising a hydrocarbon solvent, an extreme pressure lubricant, surfactants and a thickener to increase the viscosity of said cleaning solution and thereby ensure effective coating of said gears to provide the required lubrication to said gears, continuing to contact the gears with the cleaning solution for sufficient time for the solution to loosen and/or remove surface residues from the gears, and thereafter slowing the rate of rotation of the gears to a slow non operating speed not requiring effective lubrication of said gears, and thereafter rinsing the surfaces of the gears with a water based liquid to remove the loosened surface residues and the cleaning solution applied to the gears and including substituting, when a higher performance rate of the cleaning solution is required, a terpene for a portion of the amount of solvent.

2. A method cleaning mill gears and large diameter industrial drive gears as claimed in claim 1 wherein any substituted terpene is d-limonene.

3. A method of cleaning mill gears and large diameter industrial drive gears as claimed in claim 2 wherein d-limonene is present in an amount up to about 40%.

4. A method as claimed in claim 1, wherein said hydrocarbon solvent is a mineral spirit.

5. A method as claimed in claim 1, wherein said surfactants are one or more compounds selected from the group consisting of condensates of alkanolamine with fatty acids and condensates of ethylene oxide with fatty acids, fatty alcohols or alkyl aryls.

6. A method as claimed in claim 1, wherein said surfactants are one or more compounds selected from the group consisting of condensates of ethylene oxide with alkyl phenol and condensates of diethanolamine with fatty acids.

7. A method as claimed in claim 1, wherein said thickeners are one or more compounds selected from the group consisting of polymers and fatty acid amines.

8. A method of cleaning mill gears and large diameter industrial drive gears soiled with gear lubes, greases and hardened residues which are difficult to remove, said method comprising applying a cleaning solution which does not include methylene-chloride, said cleaning solution being capable of dissolving or softening hardened lubricating residues on said gears during operation of the gears, said cleaning solution comprising a hydrocarbon solvent, an extreme pressure lubricant, surfactants and a thickener to increase the viscosity of said cleaning solution and thereby ensure effective coating of said gears to provide the required lubrication to said gears, continuing to contact the gears with the cleaning solution for sufficient time for the solution to loosen and/or remove surface residues from the gears, and thereafter slowing the rate of rotation of the gears to a slow non operating speed not requiring effective lubrication of said gears, and thereafter rinsing the surfaces of the gears with a water based liquid to remove the loosened surface residues and the cleaning solution applied to the gears.

9. A method as claimed in claim 8 wherein said water based liquid is water-emulsifier soap solution.

10. A method as claimed in claim 8, wherein said hydrocarbon solvent is a mineral spirit.

11. A method as claimed in claim 8, wherein said surfactants are one or more compounds selected from the group consisting of condensates of alkanolamine with fatty acids and condensates of ethylene oxide with fatty acids, fatty alcohols or alkyl aryls.

12. A method as claimed in claim 11, wherein said surfactants are one or more compounds selected from the group consisting of condensates of ethylene oxide with alkyl phenol and condensates of diethanolamine with fatty acids.

13. A method as claimed in claim 8, wherein said thickeners are one or more compounds selected from the group consisting of polymers and fatty acid amines.

14. A method as claimed in claim 8 wherein the ration of time the mill gear is in operation during the cleaning process to the time the mill gear is not in operation is not greater than 5 to 1.

15. A method as claimed in claim 1 wherein said water based liquid is water-emulsifier soap solution, said hydrocarbon solvent is a mineral spirit, said surfactants are one or more compounds selected from the group consisting of condensates of alkanolamine with fatty acids and condensates of ethylene oxide with fatty acids, fatty alcohols or alkyl aryls, and wherein said water-emulsifier soap is heated prior to application to said gears.

16. A method as claimed in claim 11 wherein said water based liquid is water-emulsifier soap solution and is spray applied to said gears at a pressure in the range of 1200 to 2000 psi and is heated prior to application.

* * * * *